US006305955B1

(12) United States Patent
Billman

(10) Patent No.: US 6,305,955 B1
(45) Date of Patent: Oct. 23, 2001

(54) BRACKET HAVING A RECOVERABLE DOOR

(75) Inventor: Timothy B. Billman, Dover, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/576,739

(22) Filed: May 23, 2000

(51) Int. Cl.[7] ..... H01R 13/453

(52) U.S. Cl. ..... 439/138

(58) Field of Search ..... 439/138, 137, 439/136, 607–610

(56) References Cited

U.S. PATENT DOCUMENTS 5,879,173 * 3/1999 Poplawski et al. ..... 439/138
6,095,862 * 3/1999 Doye et al. ..... 439/138

* cited by examiner

*Primary Examiner*—Gary Paumen
(74) *Attorney, Agent, or Firm*—Wei Te Chung

(57) ABSTRACT

A bracket is provided for receiving an external electrical device. The bracket comprises a dielectric frame and a door rotatably positioned on the dielectric frame by a shaft traversing the door. The shaft terminates as a cam portion at each distal end thereof. A metal shielding is fixingly attached to the dielectric frame and comprises a spring arm proximating to the cam portion of the door. The cam portion of the door is rotated to deform the spring arm of the metal shielding when the external electric device is inserted into the bracket from the door.

1 Claim, 7 Drawing Sheets

BRACKET HAVING A RECOVERABLE DOOR

BACKGROUND OF THE INVENTION

1. Field of the Invention

The present invention relates to a bracket for receiving an external device such as a transceiver module or the like and, more particularly, to a bracket having a recoverable door which will be opened from an original closed position when the external device is inserted into the bracket, and which will recover to the original closed position when the external device is withdrawn from the bracket.

2. The Prior Art

Brackets have been used in many electrical devices such as personal computers or high frequency appliances for receiving an external electrical device to be inserted thereinto. The bracket is normally installed with a door for avoiding entrance of dust into the bracket, which if accumulated for a specific amount will affect the performance of the inserted electrical device, especially when the inserted electrical device is a high frequency device, such as a gigabit interface converter module.

Earlier efforts to provide a metal door installed in a bracket may be referred to U.S. Pat. No. 5,879,173, wherein a door is hinged with respect to a mounting panel with a shaft thereof and a coil spring is mounted on each shaft end of the door for returning the door to its closed position after the door is opened. Normally, the assembling of the coil spring to the door is cumbersome. Moreover, the coil spring is apt to be detached from the shaft end after several times of operation thus causing malfunction. It is requisite to provide a new structure which can solve the problem as encountered in the conventional bracket using coil springs.

SUMMARY OF THE INVENTION

The primary purpose of the present invention is to provide a new bracket having a new recovery metal door which guarantees itself to be recovered to an original closed position after being opened.

According to one aspect of the present invention there is provided a bracket for receiving an external electrical device. The bracket comprises a dielectric frame and a door rotatably positioned on the dielectric frame by a shaft traversing the door. The shaft terminates as a cam portion at each distal end thereof. A metal shielding is fixingly attached to the dielectric frame and comprises a spring arm proximating to the cam portion of the door. The cam portion of the door is rotated to deform the spring arm of the metal shielding when the external electric device is inserted into the bracket from the door.

DETAILED DESCRIPTION OF THE PREFERRED EMBODIMENT

Figure 1:
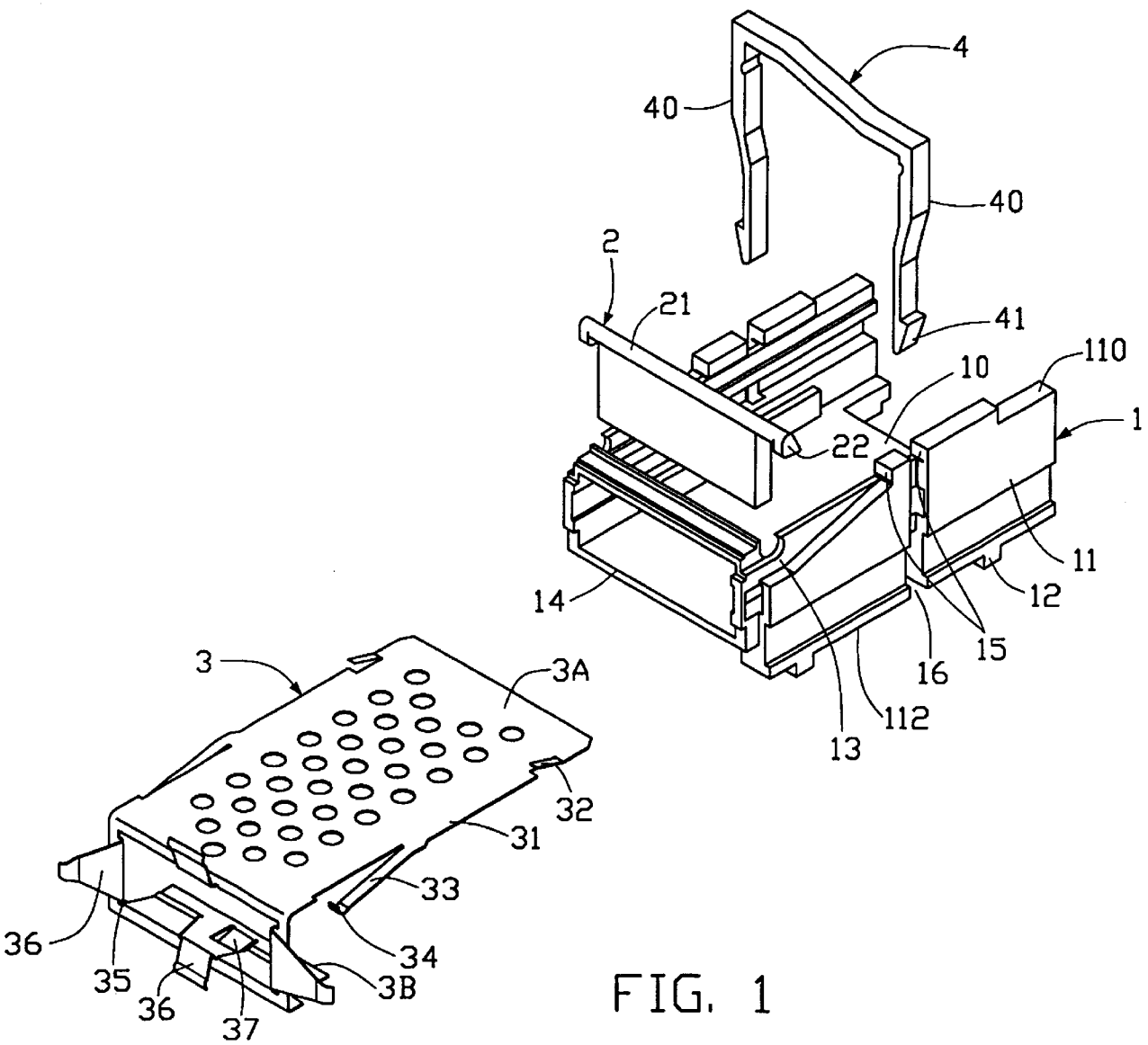
FIG. 1 is an exploded view of a bracket in accordance with the present invention having a dielectric frame, a metal door, a metal shielding, and a clip.

Referring to FIG. 1, a bracket in accordance with the present invention comprises a dielectric frame 1 made by die casting, a metal door 2 ready to be received in the dielectric frame 1, a metal shielding 3 ready to be engaged with the dielectric frame 1, and a U-shaped clip 4 for further fixing the metal shielding 3 and the dielectric frame 1 together and finally mounting the two to a through hole of a printed circuit board (not shown).

The dielecric frame 1 has a substantially U-shaped structure having a bottom 10 and two side walls 11 extending upright from two sides of the bottom 10. Each side wall 11 has a top surface 110 and an opposite bottom surface 112. Two posts 12 extend downward from the bottom surface 112 of each side wall 11 for positioning the dielectric frame 1 on the printed circuit board (not shown). A beam 17 is connected between same front ends of the side walls 11 thus forming a first gate 14 for entrance of an external electrical device (see FIG. 5, numeral 8). A pair of positioning recesses 13, actually cutouts in this embodiment, are defined in opposite positions defined in the side walls 11. Two spaced-away flanges 15 extend from a top surface 110 of each side wall 11 and each flange 15 is spaced from the top surface 110 for a predetermined distance allowing a piece of metal sheet to be received therebetween. A positioning groove 16 is defined in a top-down manner substantially in a middle portion of each side wall 11. The positioning grooves 16 opposite to each other constitute a positioning member for retaining the U-shaped clip 4 which will be detailed later.

The metal door 2 is basically a plate having a shaft 21 formed at the top thereof and extending beyond opposite sides of the plate for a small distance. The shaft 21 terminates at each distal end thereof as a cam 22.

Figure 2:
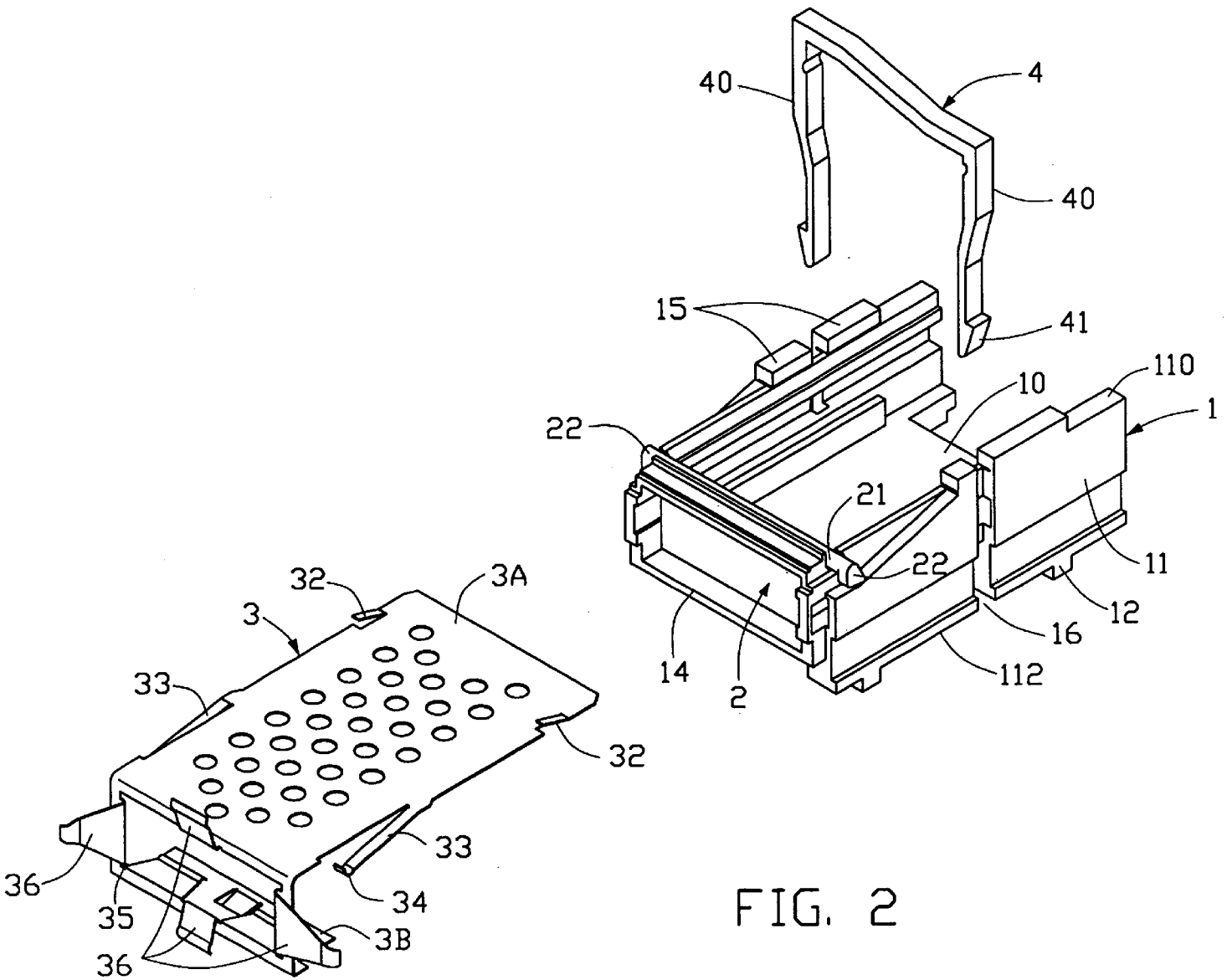
FIG. 2 is a view similar to FIG. 1, except that the metal door has been configured to the dielectric frame.

Also referring to FIG. 2, the metal door 2 is configured to the dielectric frame 1 by locating the shaft 21 thereof in the positioning recesses 13, with the cams 22 thereof respectively extending beyond the side walls 11 while the plate portion of the metal door 2 is positioned between the side walls 11 and blocks the entrance of the gate 14 which is defined by the beam 17 and a front portion of the dielectric frame 1. With this configuration, the metal door 2 can be rotated with respect to the dielectric frame 1.

Further referring to FIG. 1, the metal shielding 3 comprises an upper long plate 3A connected to a second gate 35 which is further connected to a lower short plate 3B which is substantially parallel to the upper long plate 3A. The upper long plate 3A has a pair of first latches 32 shaped like upward tangs formed at opposite sides 31 thereof near a far end of the upper long plate 3A with respect to the second gate 35. A pair of spring arms 33 shaped like downward tangs is also formed at the opposite sides 31 near the second gate 35 and each spring arm 33 has a curved end 34. Four grounding tabs 36 extend from the second gate 35 for making electrical contact with a metal enclosure, such as a server enclosure (not shown) which accommodates the bracket therein when the bracket is used with the metal enclosure. A lower latch 37 is formed in the lower short plate 3B for engaging with a tapered protrusion (not shown) formed at the bottom surface of the dielectric frame 1.

Figure 3:
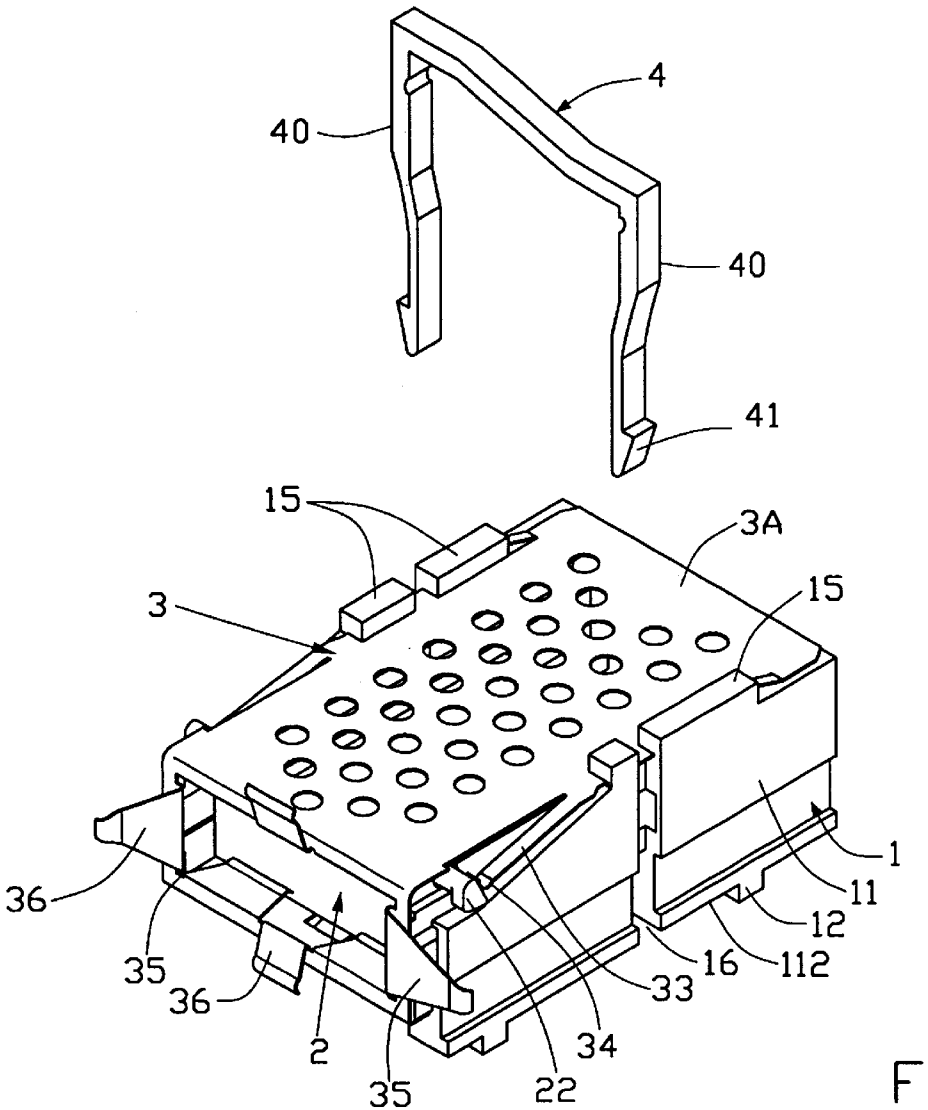
FIG. 3 is a view similar to FIG. 2, except that the metal shielding has been configured to the dielectric frame.

Also referring to FIG. 3, the metal shielding 3 is configured to the dielectric frame 1 by sliding the upper long plate 3A and the lower short plate 3B respectively along the top surface 110 and the bottom surface 112 of the side wall 11 of the dielectric frame 1 until the second gate 35 abuts against the first gate 14 of the dielectric frame 1. Meanwhile each first latch 32 abuts against a corresponding one of the flanges 15, and the second latch 37 abuts against the tapered protrusion (not shown) formed at the bottom surface of the dielectric frame 1, thereby firmly fixing the metal shielding to the dielectric frame 1.

Figure 4:
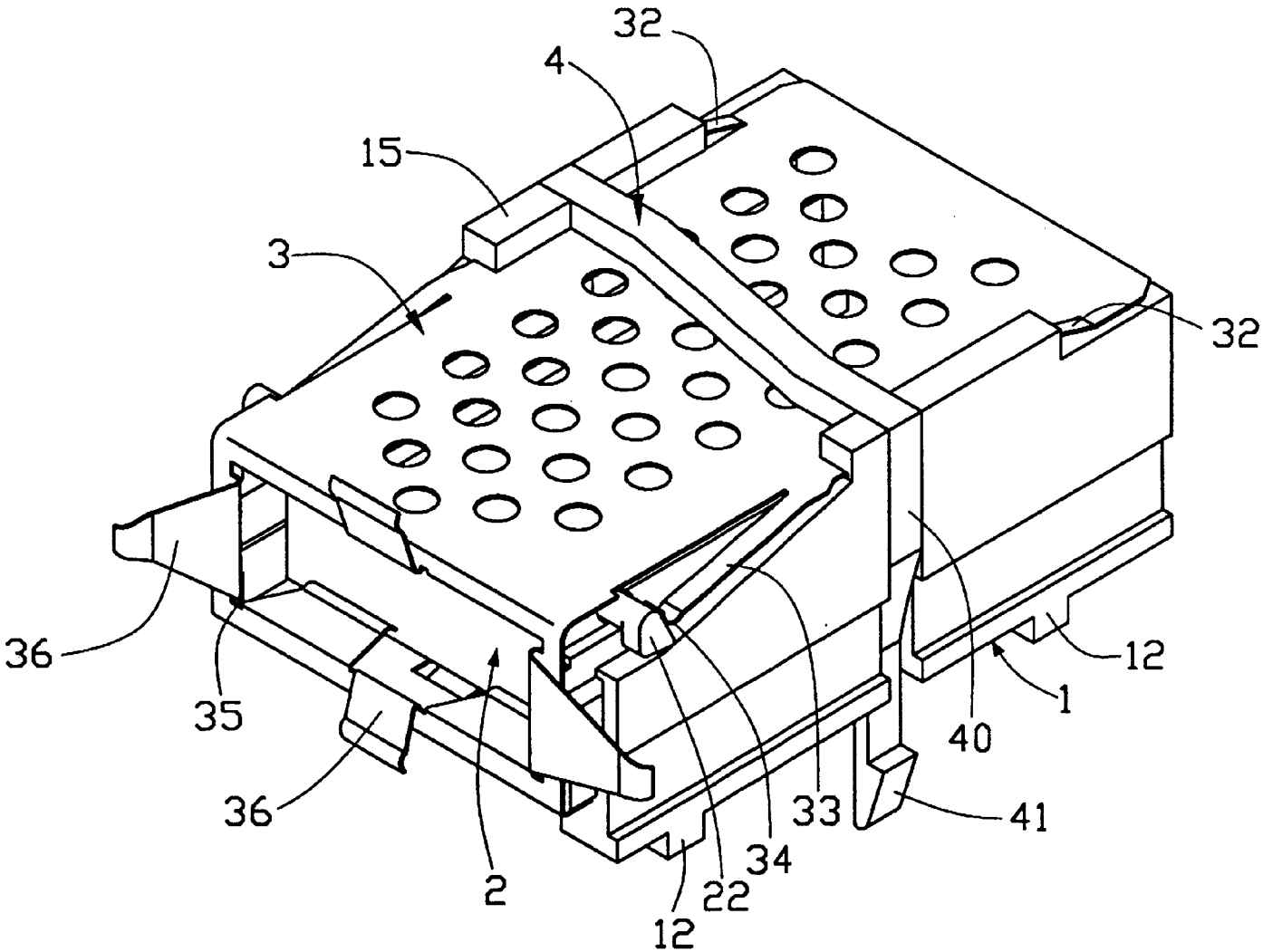
FIG. 4 is a view similar to FIG. 3, except that the clip has been configured to the dielectric frame.

Also referring to FIG. 4, the U-shaped clip 4 comprises two prongs 40 which terminate as tapered ends 41. After the configuration of FIG. 3, the U-shaped clip 4 is then attached to the dielectric frame 1 by inserting the prongs 40 thereof to the positioning grooves 16, with the tapered ends 41 thereof extending beyond the bottom of the dielectric frame 1 functioning as a board lock for further mounting the whole bracket to the printed circuit board (not shown). Therefore, the bracket is well assembled and fixed to the printed circuit board (not shown) in FIG. 4. From above, it can be appreciated that the assembling of the bracket is quite simple and the assembled structure thereof is stable for long term use.

Figure 5:
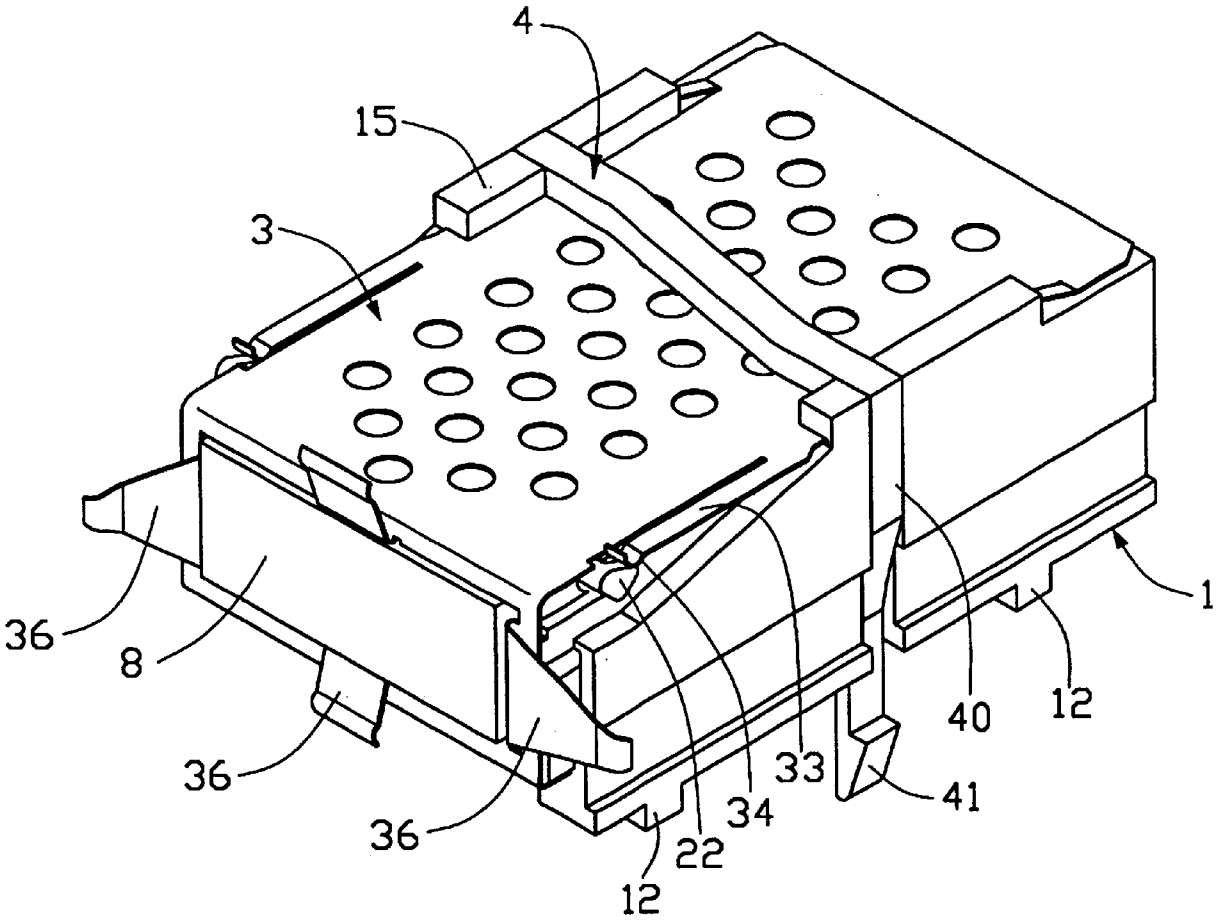
FIG. 5 is a view similar to FIG. 4, except that the metal door has been opened after insertion of an external electrical device.

Referring to FIG. 5, an external electrical device 8 having metal shell such as a gigabit interface converter module or other electrical card is inserted into the bracket, wherein the external electric device 8 is merely shown with partial schematic view for simplification. If for a practical gigabit interface converter module, a fiber cable (not shown) should be connected to the gigabit interface converter module and the fiber cable remains out of the bracket when the gigabit interface converter module is totally inserted in the bracket. When the electrical device 8 is originally inserted into the bracket from the second gate 35 (FIG. 4) thereof, the metal door 2 will be pushed inward and forced to rotate for substantially ninety degrees, meanwhile, each cam 22 will rotate for the same angle and lift the spring arm 33 to store a tension for recovering the metal door 2 back to its original position after the electrical device 8 is withdrawn from the bracket. The metal shielding 3 can prevent electrostatic discharge (ESD) damage when the electrical device is originally inserted into the bracket and also prevent electromagnetic interference (EMI) when the electrical device is retained in the bracket. The four grounding tabs 36 of the bracket are in electrical contact with the metal shell of the electrical device 8 after the electrical device 8 is inserted into and positioned in the bracket.

Figure 6:
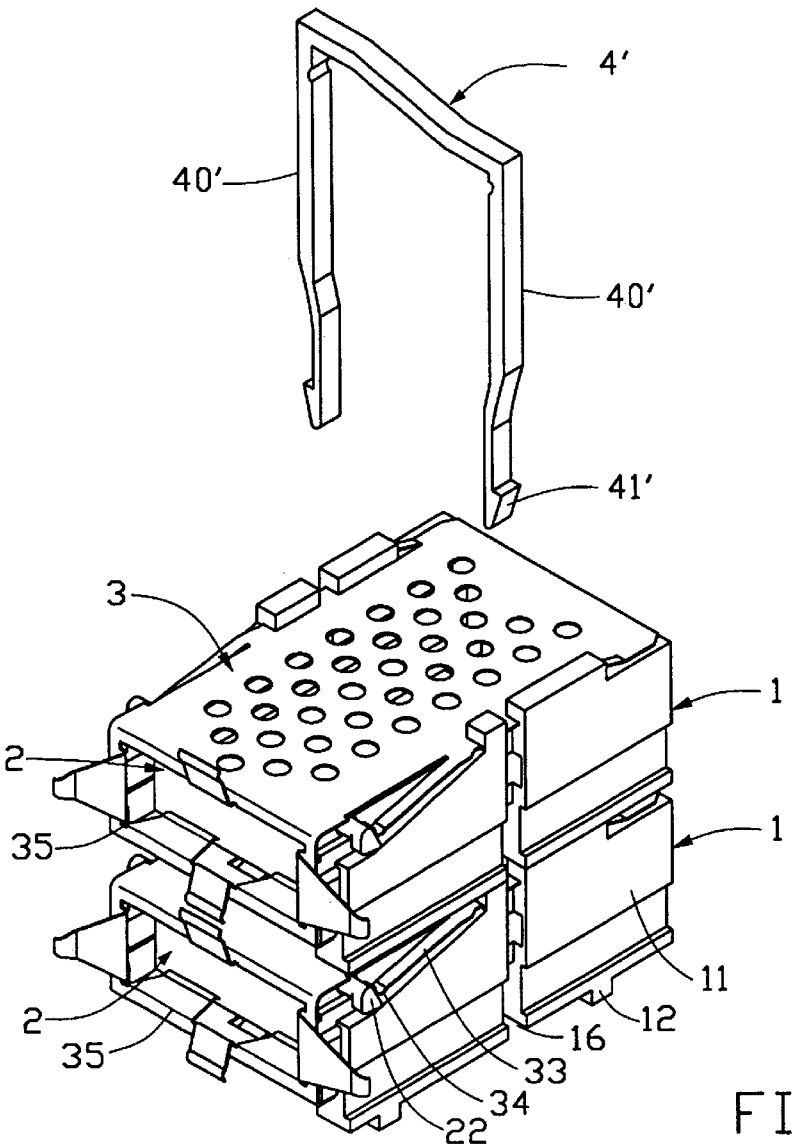
FIG. 6 is a second embodiment showing that two brackets are ready to be stacked together by a clip.

Referring to FIG. 6, a second embodiment of the present invention is shown with stacked structure, wherein the same parts regarding to those shown in the previous (first) embodiment are used with same reference numerals for simplification. In the second embodiment, the two brackets are almost identical to that of the first embodiment except that the posts 12 which extend downward from the upper bracket have been removed for configuration purpose. Moreover, the two stacked brackets commonly use a single U-shaped clip 4' which has a pair of prongs 40' longer than those shown in the first embodiment and each prong 40' terminates as a tapered end 41 for functioning like a board lock similar to that shown in the first embodiment.

Figure 7:
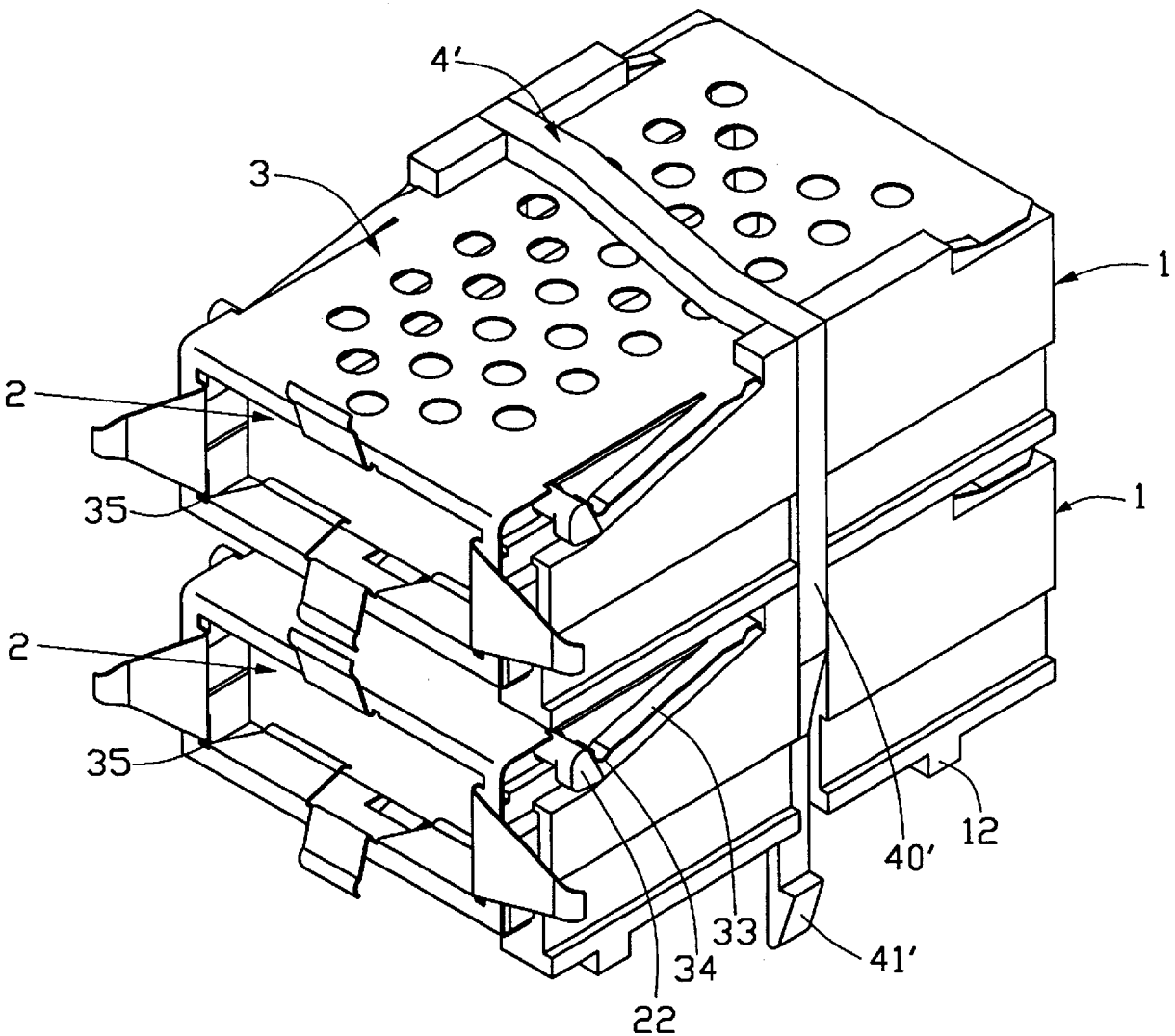
FIG. 7 is a fully assembled view of FIG. 6.

During assembling of the brackets, the corresponding positioning grooves 16 of the brackets have to be registered with each other, so that the prong 40' of the U-shaped clip 4' can be slid into and positioned in the registered positioning grooves 16 for fixing the brackets together. The stacked brackets maybe referred to FIG. 7, wherein the tapered ends 41' can be further locked into a printed circuit board for board lock function and each bracket can receive a corresponding electrical device 8 such as that shown in the first embodiment. The stacked brackets can be used in a backplane or a computer server for efficiently receiving the external electrical devices 8 therein, thus saving space which in turn causes compact size of the backplane or the computer server.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A bracket for receiving an external electrical device, the bracket comprising:

a dielectric frame;

a door rotatably positioned on the dielectric frame by a shaft traversing the door, the shaft terminating as a cam portion at each distal end thereof; and a metal shielding fixingly attached to the dielectric frame and comprising spring arms proximate to the cam portion of the door;

wherein the cam portion of the door is rotated to deform the spring arm of the metal shielding when the external electric device is inserted into the bracket from the door, the door being normally biased closed by the spring arms;

wherein the dielectric frame has a bottom and two side walls extending upright from two sides of the bottom;

wherein each side wall of the dielectric frame has a top surface and an opposite bottom surface and a post extends downwardly from the bottom surface of the side wall;

wherein a beam is connected between front ends of the side walls thus forming a gate for entrance of the external electrical device;

wherein a pair of positioning recesses are defined in opposite positions defined in the side walls of the dielectric frame for positioning the door;

wherein each of the positioning recesses is a cutout formed at a top surface of the side wall.

* * * * *